US008753234B1

(12) United States Patent
Hair

(10) Patent No.: US 8,753,234 B1
(45) Date of Patent: Jun. 17, 2014

(54) PORTABLE GOAL POST AND METHOD

(71) Applicant: Roger Hair, Stoneville, NC (US)

(72) Inventor: Roger Hair, Stoneville, NC (US)

( * ) Notice: Subject to any disclaimer, the term of this patent is extended or adjusted under 35 U.S.C. 154(b) by 0 days.

(21) Appl. No.: 14/048,457

(22) Filed: Oct. 8, 2013

(51) Int. Cl.
*A63B 63/00* (2006.01)

(52) U.S. Cl.
CPC ..... *A63B 63/00* (2013.01)
USPC ..... 473/477

(58) Field of Classification Search
CPC ..... A63B 63/00
USPC ..... 473/481, 477; 403/101, 102; 175/19, 175/61; 182/155; 211/165; 248/530; 296/3; 414/542, 746.4; 52/152; D8/682.2
See application file for complete search history.

(56) References Cited

U.S. PATENT DOCUMENTS

| | | | | | |
|---|---|---|---|---|---|
| 1,413,432 | A * | 4/1922 | Romer | 211/63 |
| 1,906,218 | A * | 4/1933 | Patchell | 403/100 |
| 2,335,584 | A * | 11/1943 | Couse | 52/114 |
| 2,629,465 | A * | 2/1953 | Rhea | 403/100 |
| 3,098,463 | A * | 7/1963 | Brown | 114/254 |
| 3,570,793 | A * | 3/1971 | Shackel | 248/515 |
| 3,675,922 | A | 7/1972 | Nieland | 273/55 |
| 5,100,132 | A * | 3/1992 | Anderson et al. | 473/481 |
| 5,572,836 | A * | 11/1996 | Parker | 52/116 |
| 5,839,733 | A | 11/1998 | Meeks et al. | 273/400 |
| 6,375,585 | B1 | 4/2002 | Driscoll | 473/477 |
| 6,394,917 | B1 | 5/2002 | Chiappini et al. | 473/415 |
| 7,014,578 | B1 | 3/2006 | Brodeur | 473/477 |
| 8,308,123 | B1 * | 11/2012 | Accordino | 248/518 |

OTHER PUBLICATIONS webpage download,RrOGERSATHLETIC, 2010, web.archive.org/web/20101101035711/http://www.rogersathletic.com/football/game-day.asp, 15 pages.*
webpage download, PALMA, 2010, web.archive.org/web/20101023184517/http://www.palma-expo.com/dollies.html, 1 page.*
webpage download, UtilityTrailerUpgrades, 2013, www.familyhandyman.com/automotive/utility-trailer/utility-trailer-upgrades, 15 pages.*
Three page printout from "rogersathletic.com" showing a stadium pro portable goal post, copyright 2010 Rogers Athletic Company.

* cited by examiner

*Primary Examiner* — Gene Kim
*Assistant Examiner* — M Chambers
(74) *Attorney, Agent, or Firm* — Blake P. Hurt

(57) ABSTRACT

A portable and collapsible goal post including a tubular base defining a T-shape perpendicularly and vertically affixed to an upright. A post is pivotably attached to the upright, and pivots between a position parallel to the base and a position perpendicular to the base. The goal post further includes a tubular cross bar perpendicularly affixed to the post in opposing relation to the upright with a pair of tubular arms pivotably attached in opposing relation to different ones of the cross bar ends, each of the arms defining an L-shape and a cup, each of the cups defining a square cross-section. The goal post also includes a pair of poles, wherein the poles are inserted into different ones of the cups and the post is pivoted into a vertical position in line with the upright. A method of using the goal post is also included.

20 Claims, 5 Drawing Sheets

PORTABLE GOAL POST AND METHOD

FIELD OF THE INVENTION

The invention herein pertains to sporting equipment and particularly pertains to a football goal post that is portable between one or more practice or game sites and may be collapsed when not in use.

DESCRIPTION OF THE PRIOR ART AND OBJECTIVES OF THE INVENTION

American football is one of the most popular sports in the United States, with the National Football League (NFL) generating billions of dollars a year in revenue. Football players often hone their craft for years before displaying their skills at the professional or collegiate level, often beginning at an early age. While the strength and speed needed to succeed at the game are provided by the players, the field and necessary equipment such as goal posts are provided by a supervisory body such as a league, school system, or the like. While the game may be played in any open field of appropriate length, the cost of installing and maintaining goal posts is significant. Further, open fields that may be utilized for a football game one day a week may have other desired purposes the rest of the week, reducing the likelihood that a permanent installation such as a goal post is a satisfactory solution.

Thus, in view of the problems and disadvantages associated with prior art equipment, the present invention was conceived and one of its objectives is to provide a goal post to be used during a football game or practice that is portable between one or more game sites.

It is another objective of the present invention to provide a collapsible goal post that can be erected vertically for use during a football game and collapsed for transportation and storage when not in use.

It is still another objective of the present invention to provide a portable football goal post that can be attached to a hitch and transported in a street-legal manner.

It is yet another objective of the present invention to provide a goal post with an electric winch for fast and efficient setup of the post.

It is a further objective of the present invention to provide a goal post with pivotable arms that rotate between a longitudinally aligned storage position and a laterally aligned use position.

It is still a further objective of the present invention to provide a collapsible goal post with a series of pins and corresponding apertures to secure the goal post in a variety of configurations for storage or transport.

It is yet a further objective of the present invention to provide a goal post that is inexpensive to manufacture and easy to use, regardless of the knowledge or strength possessed by the user.

It is a further objective of the present invention to provide a method of transporting a goal post between two or more football game venues.

It is still a further objective of the present invention to provide a method of erecting a portable football goal post from a predominantly horizontal position to a vertical position for use.

Various other objectives and advantages of the present invention will become apparent to those skilled in the art as a more detailed description is set forth below.

SUMMARY OF THE INVENTION

The aforesaid and other objectives are realized by providing a collapsing portable goal post formed from a base made of tubular metal defining a "T" shape with wheels attached on opposing sides of the "T". A vertical upright formed from tubular metal is perpendicularly attached to the base proximate the cross in the "T" base. A post formed from tubular metal is pivotably attached to the upright and pivots from a substantially horizontal position parallel to the base while being transported or in storage to a vertical position perpendicular to the base during use via a winch that is affixed to the upright. The goal post also includes a cross bar formed from tubular metal attached in perpendicular orientation to the post about a midway point on the cross bar. A pair of pivotable arms defining a "L" shape are opposingly attached to the cross bar with pins that secure the arms in either a longitudinal position about perpendicular to the cross bar or a lateral position in line with the cross bar. The arms each define a squared cup on the arm end opposing the end attached to the cross bar, the cups are sized to receive poles positioned therein to define left and right vertical posts when the goal post is assembled and in use.

A method of transporting and using the goal post described above is also included. The method includes the step of providing a goal post as defined, pivoting the arms into a position substantially in line with the cross bar, inserting poles into different ones of the cups on the arms to form a goal post, and rotating the goal post into a substantially vertical position, perpendicular to the base.

DETAILED DESCRIPTION OF THE PREFERRED EMBODIMENT AND OPERATION OF THE INVENTION

Figure 1:
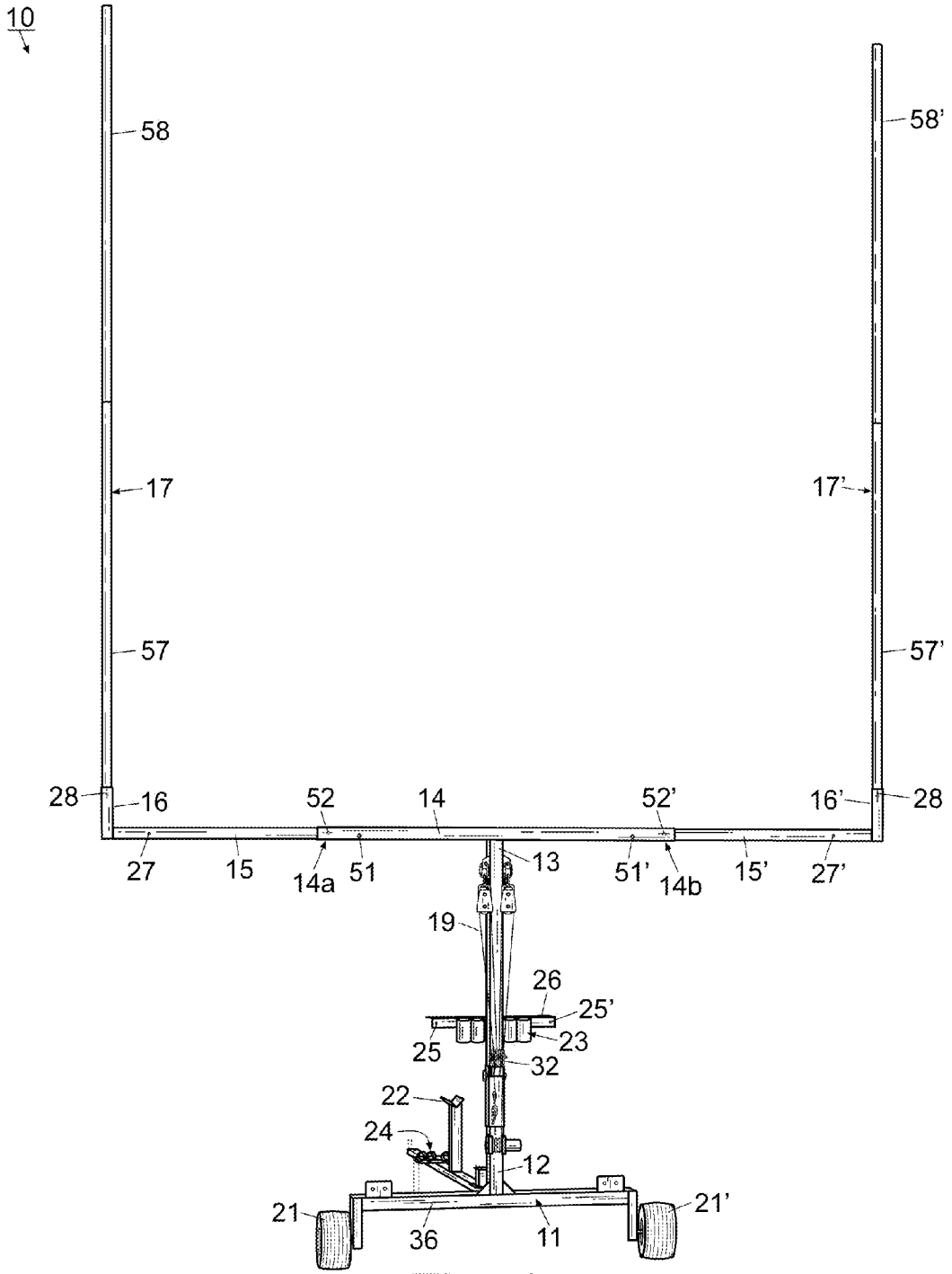
FIG. 1 shows a perspective side view of an erected goal post.

For a better understanding of the invention and its operation, turning now to the drawings, FIGS. 1-5 display preferred portable and collapsible goal post 10 as formed from tubular steel, defining a total weight of approximately seven hundred (700) pounds. FIG. 1 shows a perspective side view of goal post 10 ready for use in an erect or vertical position. During use, poles 17, 17' are inserted within cups 16, 16' respectively and positioned in a vertical orientation as shown, for example to serve as the right and left uprights to define the boundary of an American football field goal post. While shown here as an American football field goal post, this invention should not be limited to a single application, as other sport structures such as portable and collapsible basketball hoops and the like are also contemplated.

Goal post 10 is formed from base 11 which is preferably made from three inch by three inch (3"×3") square steel tubing with a quarter inch (0.25") wall thickness. Although base 11 can define numerous shapes and configurations, preferred base 11 defines a T-shape formed from base longitudinal member 35 (FIG. 3) rigidly attached to base lateral member 36 (FIG. 5), for example by welding or the like. In an alternate embodiment of goal post 10, longitudinal member 35 may be attached to base lateral member 36 with removable fasteners such as bolts, for example to ease in shipping and storage. The exact dimensions of base 11 are determined by a variety of factors such as desired weight, shape, and the like but preferred base 10 is formed from base longitudinal member 35 defining a length of about one hundred forty one inches (141") affixed about the midpoint of base lateral member 36 that defines a length of about seventy eight and a half inches (78.5"). As indicated in phantom view in FIGS. 1 and 3, base 11 may also include leveling features such as jack 37 or the like. Base 11 defining a T-shape and the measurements listed above result in a structurally stable foundation for goal post 10 that remains balanced and not overly top heavy, even when base 11 is shifted or angled. While not recommended, testing indicates that base 11 can be lifted over five feet (5') vertically, defining roughly twenty seven degrees (27°) of rotation, before goal post 10 begins to exhibit top heavy characteristics and requires anchoring to prevent goal post 10 from collapsing (not shown). This stability also allows goal post 10 not to require weighted anchors or cumbersome outriggers to support goal post 10 during operation. This is a valuable feature, for example when cheerleaders and other spectators are present in close proximity to goal post 10 during operation for the sake of public safety and conservation of space. Other accessories such as a trailer tongue for engaging a ball hitch on a towing vehicle, wiring for connecting to a tow vehicle, or a solar charger for powering power supply 20 (FIG. 3) and associated mounting hardware may be positioned on base longitudinal member 35 as would be understood in the art but are not shown and will not be discussed for the sake of brevity.

Base lateral member 36 may include opposing tail light brackets 39, 39' (FIG. 5) affixed thereto. The addition of tail lights and proper licensing (not shown) combined with the size and weight characteristics of goal post 10 serve to allow it to obtain road legal status under current Department of Transportation (DOT) regulations. As football leagues and school systems budget for play, the ability to utilize two goal posts 10 at multiple game sites, even on the same day, conveys a substantial cost savings, without which may prevent games being played and leagues being organized. Wheels 21, 21' are rotatably affixed to opposing ends of base lateral member 36. U-shaped hub brackets 40, 40' (FIGS. 2 and 4) are connected to base lateral member 36 as shown and define an axle (not shown) that serves as the connection point for respectively wheels 21, 21' as is conventional. Hub brackets 40, 40' are preferably twelve inches (12") long, two and a half inches (2.5") tall, and define an axle of sufficient length to rotatably attach a desired tire to base 11. Hub brackets 40, 40' may be integrally formed to base lateral member 36, or they may be attached, for example by welding or the like. While not shown, one or more jacks 37 may also be positioned on base lateral member 36 for assistance in leveling should goal post 10 be positioned on uneven terrain.

Figure 3:
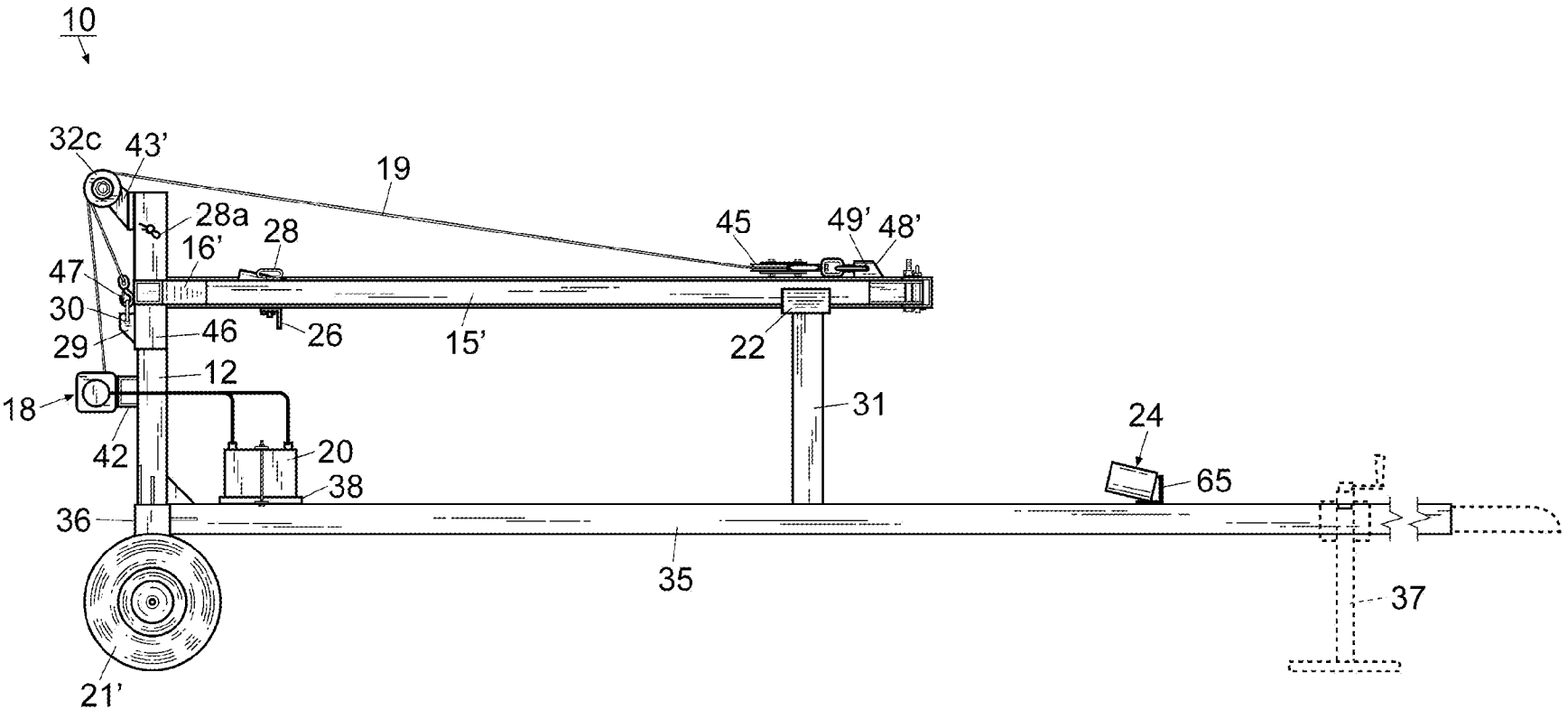
FIG. 3 depicts an elevated side view of the goal post of FIG. 1 in a collapsed, closed position without the poles.
Figure 4:
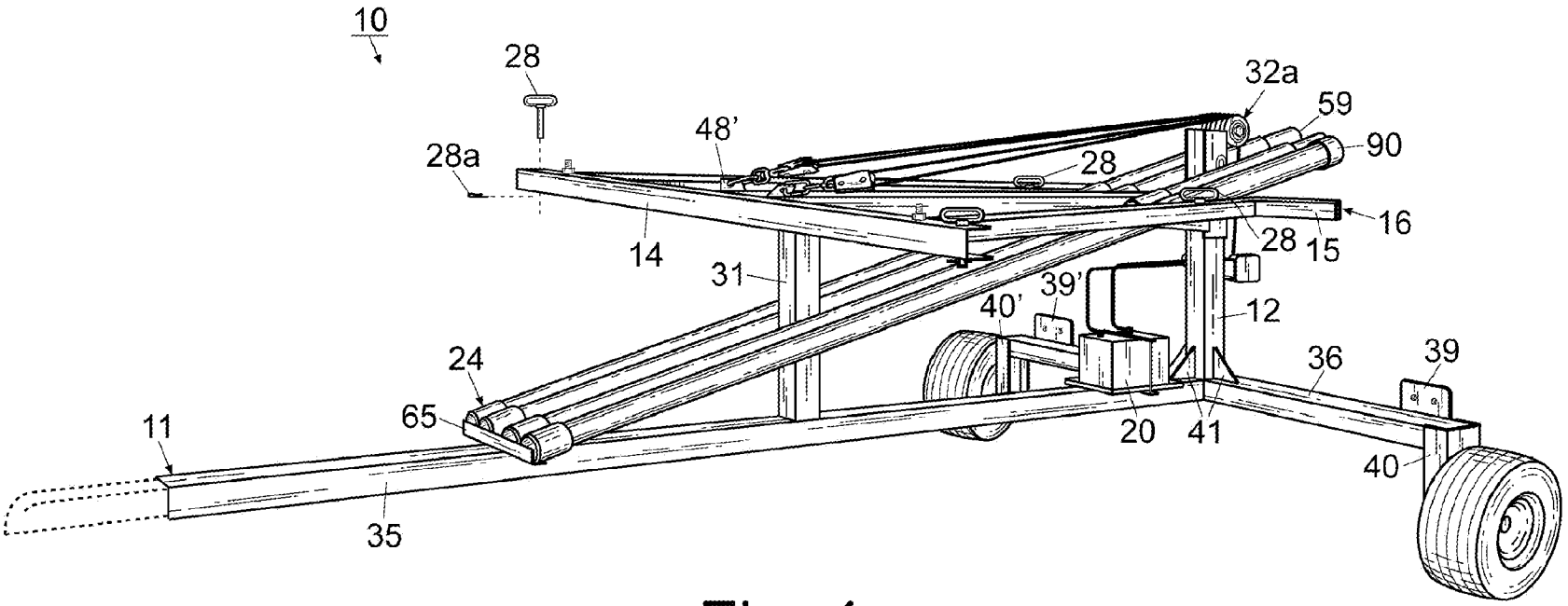
FIG. 4 demonstrates a side perspective view of the goal post of FIG. 1 in a collapsed, closed position with the poles.
Figure 5:
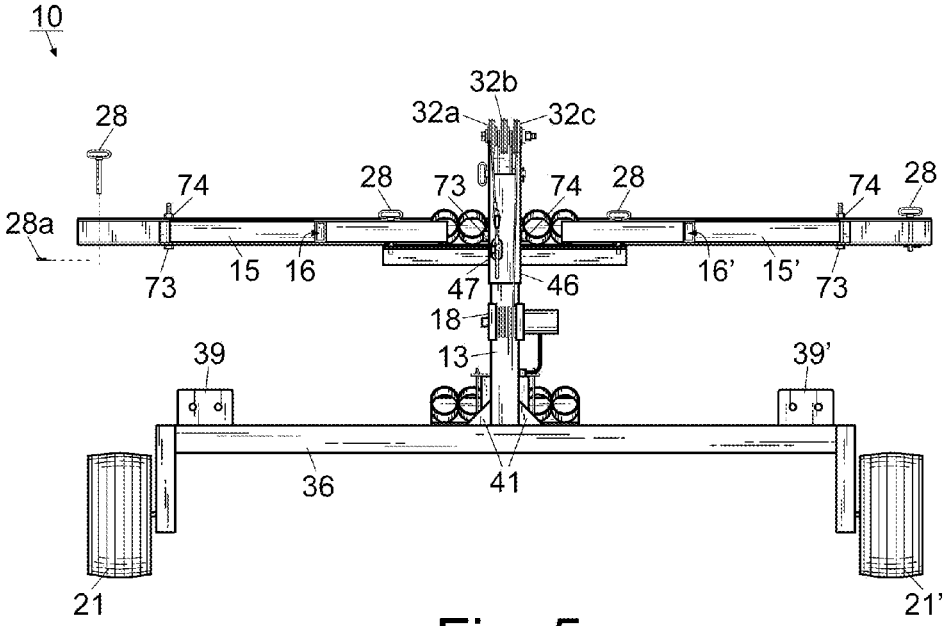
FIG. 5 illustrates an elevated end view of the goal post as seen in FIG. 3.

As shown in FIGS. 3, 4 and 5, upright 12 is rigidly attached in perpendicular orientation to base lateral member 36, for example by welding or other known metal attachment methods. Upright 12 is preferably formed from three inch by three inch (3"×3") steel square tubing defining a wall thickness of a quarter inch (0.25"). Upright 12 serves as the structural support and attachment between base 11 and post 13 (FIG. 1), and may include a plurality of gussets 41 (FIG. 4) rigidly attached thereto such as by welding or the like for added structural integrity.

Base lateral member 36 further includes cradle support 31 (FIG. 3) rigidly attached thereto in perpendicular orientation such as by welding or the like. Cradle support 31 is preferably formed from two and a half inch by two and a half inch (2.5"×2.5") steel square tubing defining a wall thickness of three-sixteenths of an inch (0.188"). Cradle support 31 includes cradle 22 rigidly affixed to the top thereof such as by welding or the like which serves as the structural support for post 13 when in a collapsed, horizontal posture as seen in FIG. 3. Cradle 22 is U-shaped and preferably formed from steel defining a four inch (4") channel five inches (5") in length.

Winch mount 42 (FIG. 3) is preferably affixed to a vertical surface of upright 12. Winch mount 42 generally defines a C-shape, preferably five inches (5") wide, three inches (3") deep, and two inches (2") high. Apertures (not shown) may be positioned in winch mount 42 as desired depending on the make and model of the winch being attached thereto. Preferably, goal post 10 includes electric Warn™ winch 18 capable of supporting at least seventeen hundred pounds (1700 lb) with a manual remote controller (not shown).

As shown in FIGS. 1-5, conventional winch 18 preferably includes five-thirty secondths inch (0.156") twisted steel cable wire 19 which connects to upright 12 (FIG. 3) and travels through respectively winch pulleys 32*a*, 32*b* and 32*c* (FIG. 5) and swivel pulleys 44, 45 (FIG. 2) described in more detail below. Pulleys 32*a*, 32*b* and 32*c* are supported by pulley support brackets 43, 43' (FIG. 2) whereas swivel pulleys 44, 45 are contained within respectively attachment pulleys 33, 33'. Attachment pulleys 33, 33' are affixed respectively to attachment hooks 34, 34' which are joined to swivel pulley hooks 50, 50' which are received in apertures 49, 49' of anchor tabs 48, 48'. Wire 19 is preferably a twisted metal wire although other structurally sound lines may also be used. As seen in FIGS. 3 and 5, wire 19 is affixed at one end to upright 12 by for example hook 47 passing through support aperture 30 defined in angled support 29 which is rigidly attached to flat bar 46. Wire 19 then passes over pulley 32*a* and extends to wrap around swivel pulley 44 (FIG. 2) where it extends to wrap around center pulley 32*b* and extends back to wrap around swivel pulley 45 and passes back down through pulley 32*c* and anchors to winch 18. Such configuration of wire 19 provides an equal, stable pulling exertion on post 13 during operation of winch 18 when raising or lowering post 13. This pulley orientation may be referred to as a "four fall" pulley system and reduces the effective force necessary to raise and lower goal post 10 equal to the post weight divided by the number of falls (four in the preferred case). As is known in the art, the number of "falls" directly supporting the weight determines the degree of "compounding".

Flat bar 46 is preferably formed from iron defining a generally C-shape sixteen inches (16") in length and fillet welded to upright 12. Although not shown, flat bar 46 may define a slot five-eighths of an inch (0.625") wide and one and a quarter inch (1.25") long centered immediately below winch pulley 32*b*. Preferred flat bar 46 includes angle support 29 which is rigidly affixed thereto such as by welding or the like and includes support aperture 30 formed therein. Angle support 29 may be positioned on any face of flat bar 46 as desired but preferably is positioned on the flat bar 46 face opposite base longitudinal member 35. Preferred angle support 29 is three inches (3") long, one and a half inches (1.5") in height, and includes a biased face on one end. Aperture 30 (FIG. 3) is preferably positioned approximately three fourths of an inch (0.75") proximate the unbiased end of angled support 29.

As shown in FIG. 3, power supply 20 may be positioned on base 11, for example by battery base 38 which is rigidly affixed to base longitudinal member 35 such as by welding or the like. Power supply 20 is preferably a twelve volt (12 v) automobile battery, although other power sources sufficient to power preferred winch 18 are also acceptable. As is conventional a bracket, such as used in cars for example, is utilized for maintaining power supply 20 on battery base 38 and as such is not described in greater detail. Further, power supply 20 is in communication with winch 18 as is conventional and as such is also not described in further detail.

Upright 12 and flat bar 46 serve as the primary attachment point for post 13. Post 13 is preferably formed from tubular steel three inches by three inches (3"×3") with a wall thickness of three sixteenths of an inch (0.188") having a length of seventy-six and three quarters inches (76.75"). Post 13 is rigidly affixed at one end about the midpoint of cross bar 14 as seen in FIG. 1, for example by welding or integrally formed therebetween. The opposing end of post 13 defines a couple of opposing pairs of apertures approximately seven inches (7") apart (not shown) on opposing sides. One of these pairs of apertures passes through the width of post 13 and defines a tube therebetween sized to receive a fastener such as bolt 73 and nut (FIG. 5) which allows post 13 to be pivotably attached to upright 12. The other pair of apertures are aligned with a pair of apertures in upright 12 for receiving hinge pin 28 and pin clip 28*a* (FIG. 3) or other suitable fastener to lock post 13 in a vertical posture once raised. Preferably, post 13 defines a pivoting end that defines a biased, arcuate terminal face to allow post 13 to transition from a substantially horizontal posture to a vertical posture when in use. Although not shown pivoting, arcuate end of post 13 with opposing pairs of apertures is equivalent to the pivoting, arcuate end of arm 15 and the opposing pairs of apertures in upright 12 are equivalent to the opposing pairs of apertures 51, 52 in cross bar 14 as described in greater detail below and as shown enlarged in FIG. 6.

Post 13 may also include post anchor tabs 48, 48' (FIG. 2) rigidly affixed thereto such as by welding or the like, each of which define respectively anchor aperture 49, 49'. Post anchor tabs 48, 48' function similarly to angle support 29, by receiving hooks 50, 50' connected to swivel pulleys 44 and 45. Post anchor tabs 48, 48' are preferably three inches (3") long, one and a half inches (1.5") tall, and define a biased face defining a forty-five degree (45°) on the end of post 13 proximate cross bar 14 such as seen in FIG. 2.

Post 13 further includes first pole keeper 23 (FIG. 2) which includes pole keeper bar 26 defining opposing apertures 25, 25' formed proximate the ends thereof and having a plurality of pole keepers 63 affixed thereto. Pole keeper bar 26 is preferably L-shaped and formed from steel and is rigidly affixed to one side of post 13 as seen in FIG. 3 such as by welding or the like. Pole keepers 63 are hollow, circular tubes preferably formed from steel. Pole keepers 63 are rigidly affixed such as by welding or the like to pole keeper bar 26 in pairs on each side of post 13.

Figure 2:
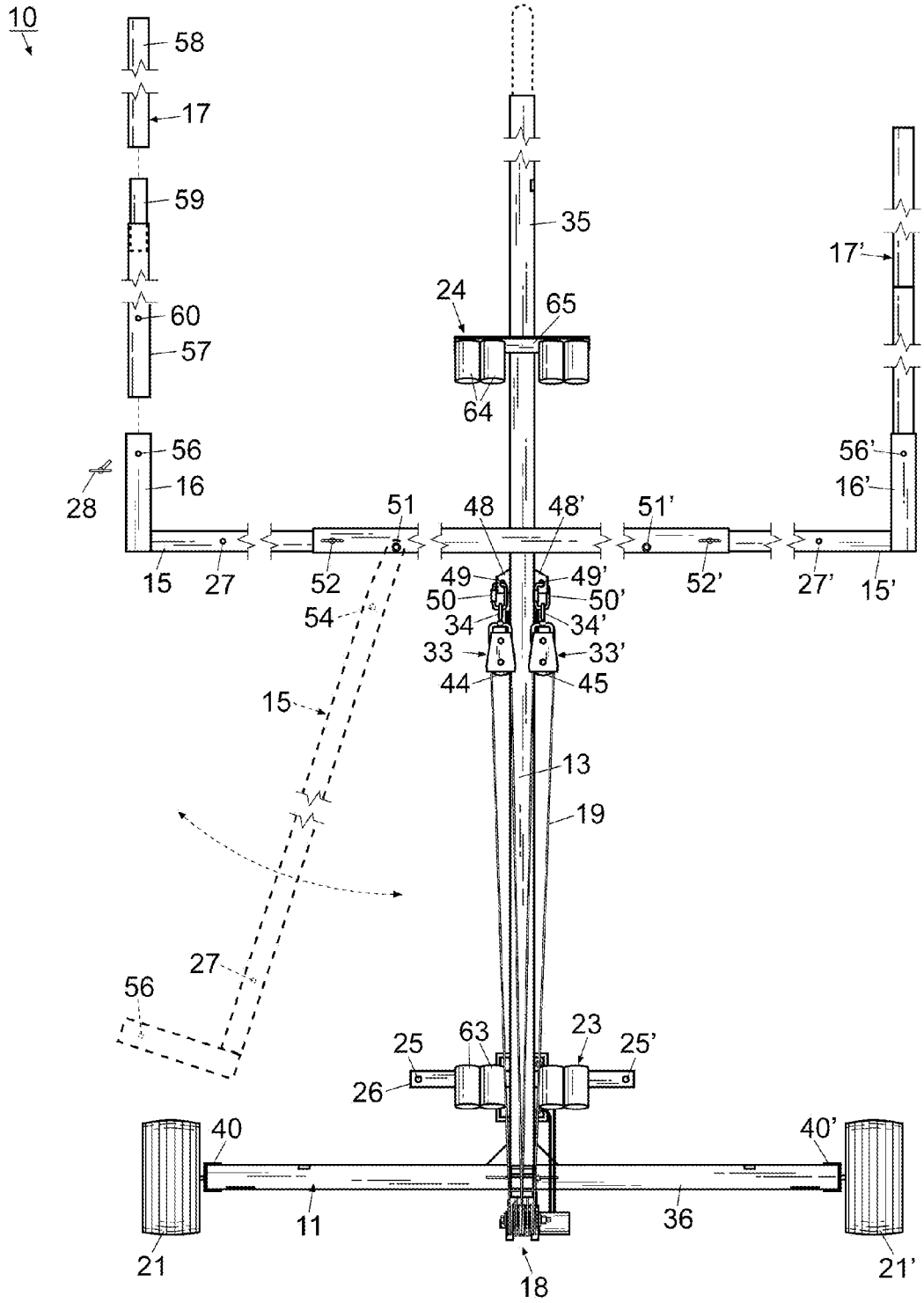
FIG. 2 pictures a top plan view of the goal post of FIG. 1 in the horizontal position prior to the goal post being raised.

Second pole keeper 24 as seen in FIGS. 2 and 3 is rigidly affixed to base longitudinal member 35 such as by welding or the like. Second pole keeper 24 includes pole keeper bar 65 having a plurality of pole keepers 64 rigidly affixed thereto. Pole keeper bar 65 is preferably L-shaped and formed from steel. Pole keepers 64 are hollow, circular tubes preferably formed from steel. Pole keepers 64 are positioned in pairs and in opposing diagonal alignment with pole keepers 63 for retaining respectively poles 57, 57', 58, 58' when not in use. As would be understood poles 57, 57', 58, 58' are each slideably received within first pole keepers 63 and then pole keepers 64 for transport and storage purposes. Pole keepers 64 are positioned such that the open ends of poles 57, 57', 58, 58' are received within the inside of the L-shape of pole keeper bar 65 as seen in FIG. 4 to act as a stop to prevent poles 57, 57', 58, 58' from sliding therethrough. Although not necessary, should it be desired, plastic caps 90 as seen in FIG. 4 can be positioned over the open ends of poles 58, 58' to prevent debris and the like from entrance to the inside thereof.

As previously described, cross bar 14 is affixed to post 13. Preferable cross bar 14 is formed from tubular steel three inches by three inches (3"×3") with a wall thickness of three sixteenth of an inch (0.188") and eighty-four inches (84") long. Preferred cross bar 14 defines a pair of opposing ends 14*a*, 14*b* as seen in FIG. 1, and each of ends 14*a*, 14*b* defines respectively a plurality of opposing pairs of apertures 51, 51', 52, 52' positioned within eleven inches (11") of either end thereof. Ends 14*a*, 14*b* of cross bar 14 as described may also define a generally C-shape with one side of the tubular wall removed to facilitate rotatable connection to arms 15, 15' as seen in FIGS. 4 and 5. In one or more alternate embodiments, apertures 51, 51', 52, 52' can be positioned in a variety of positions and are sized to receive a pin or bolt for positioning securement of respectively arms 15, 15' either for transport or use.

Figure 6:
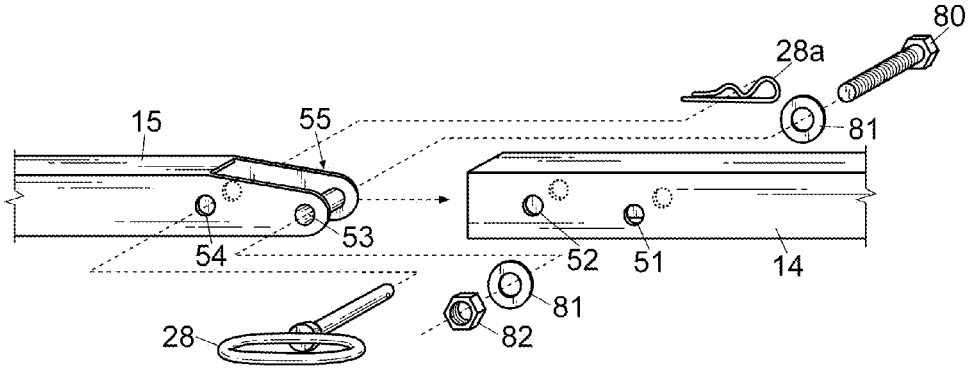
FIG. 6 shows an enlarged view of a portion of one end of the pivoting arm and a portion of one end of the crossbar prior to connection using conventional hardware.

Arms 15, 15' are rotatably attached to opposing ends 14*a*, 14*b* of cross bar 14. Although only one arm attachment will be described herein, it should be understood that all description applies equally to the other arm and that arms 15, 15' are mirror images in all respects. Arm 15 is preferably tubular steel two and a half inches by two and a half inches (2.5"×2.5") with a thickness of three sixteenths of an inch (0.188") and eighty-one and a half inches (81.5") long. Arm 15 preferably defines a pair of opposing ends, one of which is rigidly affixed to cup 16, for example by welding or being integrally formed therewith. The opposing end (the end proximate cross bar 14) defines opposing pairs of apertures 53 and 54 as seen in FIG. 6 and tapers into an arcuate terminal face 55 approximately six and three quarters inches (6.75") therefrom. Apertures 53 runs through the width of arm 15 and defines a tube therebetween sized to receive a pin or bolt 73 (FIG. 5) or 80 (FIG. 6) therein for rotation therearound and tightened by nut 74 (FIG. 5) or 82 (FIG. 6). As seen in FIG. 6, arm 15 would be inserted into cross bar 14, washer 81 would be placed over bolt 80 which is then simultaneously inserted into apertures 51 and 53 whereby another washer 81 is placed thereover and nut 82 tightened thereon to complete assembly. Apertures 53 with corresponding tube allow arm 15 to be pivotably attached by bolt 80 to cross bar 14 through apertures 51 as seen in FIGS. 1, 2 and 6. When arm 15 is pivoted outwardly from post 13, apertures 54 therein align with apertures 52 in cross bar 14 for insertion of hinge pin 28 and pin clip 28*a* in order to lock arm 15 in a fully extended posture in horizontal alignment with cross bar 14 as seen in FIGS. 1 and 2. Biased arcuate face 55 is so formed to assist in clearance for rotation of arm 15 within cross bar 14.

As would be understood although not shown the pivoting, arcuate end of post 13 with opposing pairs of apertures is equivalent to the pivoting, arcuate end of arm 15 shown enlarged in FIG. 6. Likewise, the opposing pairs of apertures in upright 12 are equivalent to the opposing pairs of apertures 51, 52 in cross bar 14 also shown enlarged in FIG. 6.

Arm 15 also defines a pair of opposing security apertures 27 positioned twelve inches (12") inboard of the end of arm 15 proximate cup 16 and sized to receive conventional hinge pin 28 with pin clip 28*a* (FIG. 3), bolt or other suitable fastener therein when goal post 10 is collapsed and in a travel configuration. When arm 15 is unlatched from its extended posture and closed such as seen for example in FIG. 2 in dotted line fashion, arm 15 rotates to rest atop pole keeper bar 26 whereby apertures 27 of arm 15 align with aperture 25 of pole keeper bar 26 and hinge pin 28 or other securing fastener is positioned therethrough to maintain arm 15 in a closed posture to prevent unwanted movement during transport as seen for example in FIGS. 3 and 4. As would be understood such movement and attachment equally applies to arm 15'.

Cups 16, 16' are each affixed to different ones of arms 15, 15' as seen in FIG. 1. Like arms 15, 15', cups 16, 16' are mirror images of one another and therefore it is understood that any description of one applies equally to the other. Cup 16 preferably defines a square cross-section measuring three inches by three inches (3"×3") with a wall thickness of three sixteenths of an inch (0.188") and a length of twelve inches (12"). Although not shown, cups 16, 16' can be designed in a variety of configurations, circular, oval, rectangular or the like. Cup 16 defines a pair of opposing cup apertures 56 (FIG. 2) proximate the end thereof, sized to receive a fastener such as a bolt or hinge pin 28 with pin clip 28*a* to removably secure pole 17 within cup 16 as described in more detail below.

A pair of opposing poles 17, 17' are identical to one another and therefore only one will be described with the understanding that the description equally applies to the other. Pole 17 is preferably a two piece construction comprising base pole portion 57 having pole insert 59 therein and upper pole portion 58. When assembled pole 17 defines a total length of two hundred forty inches (240"). Base pole portion 57 is formed from fourteen gauge (14 GA) cylindrical steel or plastic and defines an outer diameter of two and a half inches (2.5") and a length of one hundred twenty inches (120"). Base pole portion 57 defines an opposing pair of pole apertures 60 on one end thereof for receiving a bolt or pin 28 therethrough when base pole portion 57 is inserted in cup 16 and pole apertures 60 and cup apertures 56 are in coincidental relationship. At the opposing end of base pole portion 57, pole insert 59 defining a two inch (2") outer diameter is inserted and affixed therein, for example by welding or the like. Upper pole portion 58 is formed from fourteen gauge (14 GA) cylindrical steel or plastic and defines an outer diameter of two and a half inches (2.5") and a length of one hundred twenty inches (120"). Upper pole portion 58 frictionally engages pole insert 59 when assembled and abuts base pole portion 57 to form pole 17. Although not shown upper pole portion 58 may also include a steel cap for mounting an eye bolt or other similar fastener affixed to the end of pole portion 58 opposite pole insert 59, for example for displaying wind indicating flags, advertising team colors, or the like. When not in use such as during storage and transport, pole portions 57, 57', 58, 58' are inserted through pole keepers 63 of first pole keeper 23 and through pole keepers 64 of second pole keeper 24.

A method of operating goal post 10 includes transporting goal post 10 to a desired venue, for example by attaching goal post 10 to a vehicle via a conventional ball hitch towing system. Upon arrival, goal post 10 is disconnected from the towing vehicle and may deploy one or more of jack 37 for leveling as seen in FIG. 3. Thereafter, pins 28 are removed from arms 15, 15' which are pivoted outwardly from post 13 from a closed, transport position to a use position as seen in FIG. 2 generally perpendicular to base longitudinal member 35 such that arm apertures 54, 54' (54' not shown) and cross bar apertures 52, 52'(52' not shown) are in coincidental relationship and positioned to receive hinge pins 28 to lock arms 15, 15' in an extended posture in horizontal alignment with cross bar 14. Base pole portions 57, 57' are then removed from respective pole keepers 63, 64 and inserted into respectively cups 16, 16', aligning base pole apertures 60, 60' (60' not shown) with respectively cup apertures 56, 56' such that pins 28 can be inserted thus securing base pole portions 57, 57' to cups 16, 16' respectively. Upper pole portions 58, 58' are then removed from respective pole keepers 63, 64 and are frictionally engaged with respective pole inserts 59, 59' (59' not shown) whereby assembly of poles 17, 17' is complete and goal post 10 is prepared to be elevated from a horizontal posture with base longitudinal member 35 to a vertical posture perpendicular to base longitudinal member 35. A user may engage winch 18, for example with a winch controller (not shown), causing wire 19 to constrict through swivel pulleys 44, 45 and winch pulleys 32*a*, 32*b* and 32*c*, respectively, causing the overall length of spooled wire 19 to be reduced urging post 13 to rotate upwardly from its substantially horizontal transport position to a vertical posture. Once post 13 is fully upright and the apertures in post 13 are aligned with the apertures in upright 12, winch 18 is stopped and hinge pin 28 with pin clip 28*a* (FIG. 3) is inserted through the apertures to secure post 13 in a vertical orientation as seen in FIG. 1 thus completing assembly of goal post 10.

Preferably, goal post 10 can be assembled and erected in less than four minutes, allowing a practice to begin sooner and wasting less time preparing the field for play. When the practice is over, the process is reversed and goal post 10 can be transported in a street legal fashion to another location or stored as necessary.

The illustrations and examples provided herein are for explanatory purposes and are not intended to limit the scope of the appended claims. The measurements and angles are included to satisfy the statutory requirements but should not be used to limit the scope of any resulting claim.

I claim:

1. A portable and collapsible goal post comprising: a base, a wheel, said wheel rotatably attached to said base, an upright, said upright perpendicularly affixed to said base, a singular post, said singular post pivotably attached to said upright, a cross bar, said cross bar defining a pair of opposing ends, a fastener, said cross bar perpendicularly affixed to said singular post and defining a pair of apertures proximate one of said ends and sized to receive said fastener, an arm, said arm pivotably connected to said cross bar, said arm defining a first end with an arcuate face defining a pair of apertures sized to receive said fastener and a second end defining a cup, a pole, said cup sized to receive said pole, said first end oriented to said cross bar such that said cross bar apertures and said first end apertures are coincidentally aligned when said cross bar and said arm are in horizontal alignment, wherein said pole is positioned within said cup and said post is pivoted into vertical alignment with said upright.

2. The goal post of claim 1 further comprising a winch, said winch positioned proximate said upright, said winch in communication with said post.

3. The goal post of claim 2 further comprising a wire, said wire connected to said winch and said post.

4. The goal post of claim 2 further comprising a power supply, said power supply attached to said base and in communication with said winch.

5. The goal post of claim 1 further comprising a first pole keeper, said first pole keeper positioned on said post, said first pole keeper sized to receive said pole.

6. The goal post of claim 5 comprising a second pole keeper, said second pole keeper attached to said base and positioned in opposing diagonal relation to said first pole keeper.

7. The goal post of claim 1 wherein said arm further comprises an aperture proximate said second end and wherein said post comprises an L-shaped pole keeper support, said L-shaped pole keeper support attached to a side of said post, said L-shaped pole keeper support defining an aperture, said L-shaped pole keeper support aperture and said arm second end aperture sized to receive a fastener when said arm aperture and said L-shaped pole keeper support aperture are in coincidental relation.

8. The goal post of claim 1 further comprising a cradle, a cradle support, said cradle support affixed to said cradle, said cradle support perpendicularly attached to said base distal to said upright.

9. The goal post of claim 1 further comprising a four fall pulley system.

10. A portable and collapsible American football goal post comprising: a tubular base defining a T shape, a pair of wheels, said wheels rotatably attached to said tubular base, a tubular upright, said upright perpendicularly and vertically affixed to said base, one and only one tubular post, a pair of pins, said post pivotably attached to said upright, said post pivotable between a position parallel to said base and a position perpendicular to said base, a tubular cross bar, said cross bar defining a pair of opposing ends and defining two pairs of apertures proximate each of said ends sized to receive one of said pins, said cross bar perpendicularly affixed to said post in opposing relation to said upright, a pair of tubular arms, said pair of arms pivotably attached in opposing relation to different ones of said cross bar ends, each of said pair of arms defining an L-shape with a first end including an arcuate face defining a pair of apertures sized to receive said pin and a second end defining a cup, each of said cups defining a square cross-section, a pair of poles, each of said cups sized to receive different ones of said pair of poles therewithin, each of said first ends insertable within said cross bar such that said cross bar apertures and said first end apertures are coincidentally aligned when said cross bar and said arms are in horizontal alignment, wherein said poles are inserted into different ones of said cups and said post is pivoted into vertical alignment with said upright.

11. The goal post of claim 10 further comprising a winch, said winch positioned proximate said upright, said winch in communication with said post.

12. The goal post of claim 11 further comprising a power supply, said power supply attached to said base and in communication with said winch.

13. The goal post of claim 10 wherein said T-shaped base defines a lateral, member and a longitudinal member, said longitudinal member rigidly affixed centrally to said lateral member in perpendicular relation.

14. The goal post of claim 10 further comprising a cradle, a cradle support, said cradle support affixed to said cradle, said cradle support perpendicularly attached to said base distal and parallel with said upright.

15. The goal post of claim 10 further comprising a first pole keeper, a second pole keeper, said pole keepers each sized to receive said pole, said first pole keeper positioned on said post, said second pole keeper attached to said base and positioned in opposing diagonal relation to said first pole keeper.

16. The goal post of claim 10 further comprising a four fall pulley system and a cradle support defining a height that prevents said pivotable post from rotating past a horizontal position.

17. A method of assembling the collapsible and portable goal post of claims 1 or 10, said method comprising the steps of:

a) utilizing the goal post of claim 1;

b) pivoting the arm into horizontal alignment with the cross bar;

c) inserting the pole into the cup; and d) rotating the post into a substantially vertical position, perpendicular to the base.

18. The method of claim 17 further comprising the steps of:

a) providing a winch in communication with a power supply and the post; and b) engaging the winch to rotate the post into a substantially vertical position, perpendicular to the base.

19. The method of claim 17 wherein utilizing the goal post of claim 1 further comprises the step of utilizing a post with a four fall pulley system.

20. The method of claim 17 further comprising the step of transporting the goal post over a public roadway.

* * * * *